US005400730A

United States Patent [19]

Moll et al.

[11] Patent Number: 5,400,730

[45] Date of Patent: Mar. 28, 1995

[54] SEWING DEVICE HAVING A DETACHABLY MOUNTED LOOPER BLOCK FOR BOBBIN CHANGING

[75] Inventors: Philipp Moll, Aachen, Germany; Norbert Laschet, Simpelveld, Netherlands

[73] Assignee: Moll Automatische Naehsystems GmbH i.g., Germany

[21] Appl. No.: 296,607

[22] Filed: Aug. 29, 1994

Related U.S. Application Data

[63] Continuation of Ser. No. 39,165, Apr. 12, 1993, abandoned.

[30] Foreign Application Priority Data

Aug. 14, 1991 [DE] Germany ..... 41 26 788.5

[51] Int. Cl.[6] ..... D05B 57/22; D05B 59/04

[52] U.S. Cl. ..... 112/186; 112/168; 112/279

[58] Field of Search ..... 112/220, 260, 168, 186, 112/279, 181

[56] References Cited

U.S. PATENT DOCUMENTS

| | | | |
|---|---|---|---|
| 3,447,499 | 6/1969 | Yoshihiko et al. | 112/181 |
| 3,675,603 | 7/1972 | Yamashita | 112/168 |
| 4,590,875 | 5/1986 | Sanvito et al. | 112/260 X |
| 4,624,201 | 11/1986 | Maggi | 112/260 X |
| 4,690,081 | 9/1987 | Castagna et al. | 112/220 X |

*Primary Examiner*—Clifford D. Crowder
*Assistant Examiner*—Paul C. Lewis
*Attorney, Agent, or Firm*—Diller, Ramik & Wight

[57] ABSTRACT

A sewing device (13) consists of a basic unit (13) comprising the main motor, the needle bar (27), and the take-up lever (31), and a shuttle block (24) detachably mounted thereto which comprises the shuttle (35) with the thread bobbin (36) for the lower thread. For changing an empty thread bobbin, the sewing machine mounted to a robot arm is inserted into a reception unit (21) in which the shuttle block (24) remains, whereas the basic unit (23) is moved to another shuttle block with full thread bobbin (36a) and receives it. The sewing machine does not require a time-consuming manual change of the thread bobbin for the lower thread.

15 Claims, 5 Drawing Sheets

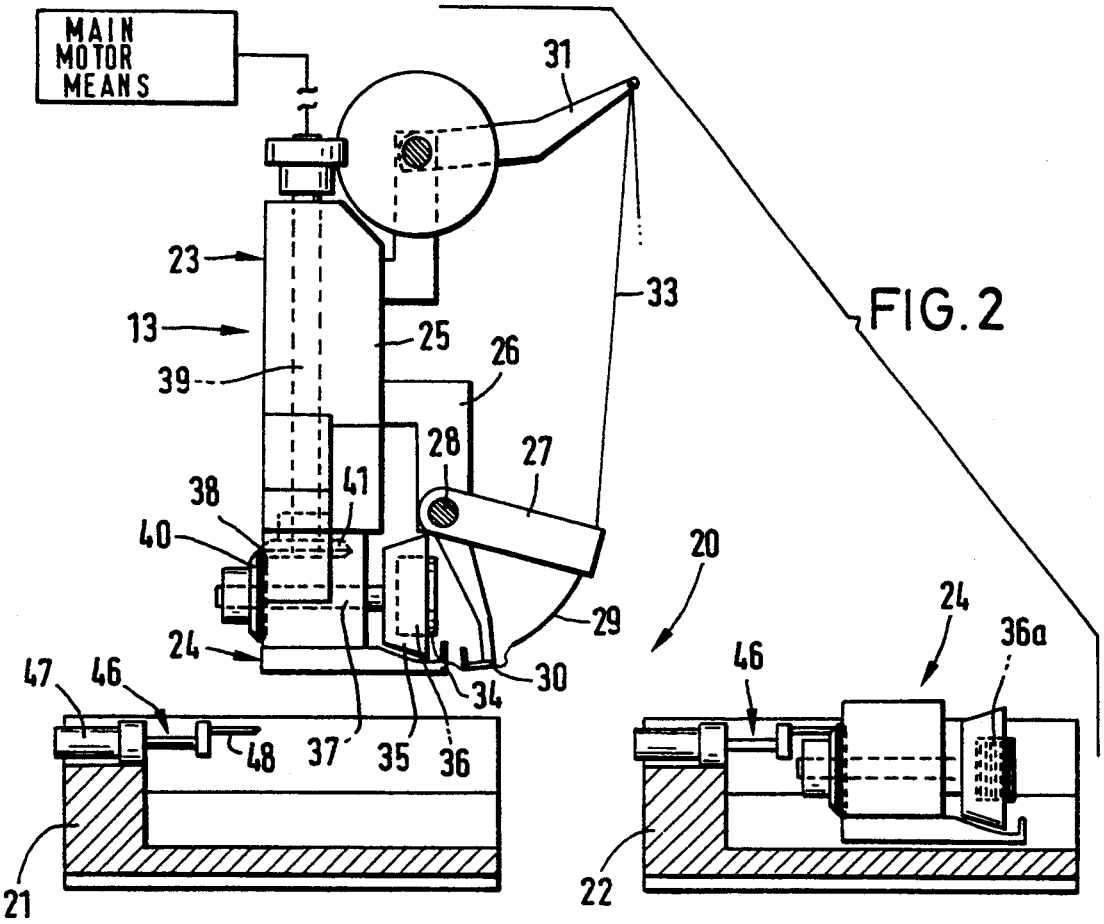
FIG. 2
FIG. 3
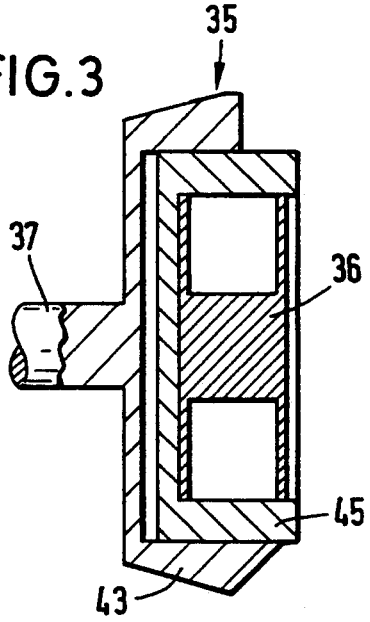
FIG. 4
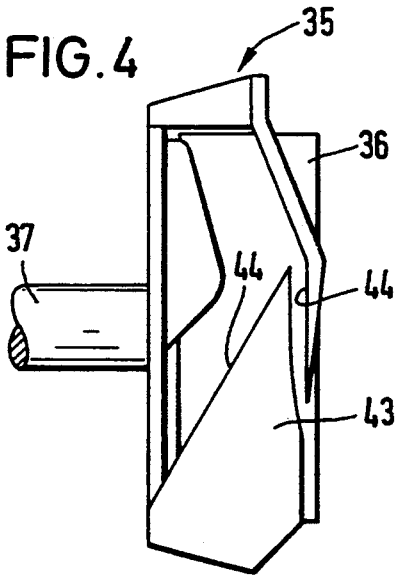

SEWING DEVICE HAVING A DETACHABLY MOUNTED LOOPER BLOCK FOR BOBBIN CHANGING

This application is a continuation of application Ser. No. 08/039,165, filed Apr. 12, 1993, now abandoned.

BACKGROUND OF THE INVENTION

The invention is directed to a sewing device with a sewing machine being movable by a robot arm or another moving device and adapted to be led e.g. along the intended seam line.

The common sewing machines (e.g. according to the book of Wilhelm Renters "*Die Nahmaschine in Schule und Haus*", 1951, publishing company Hermann Kayser, Kaiserslautern) are stationary. They comprise a plate onto which the material to be sewn is placed, as well as a holding-down member which presses the material to be sewn against the plate. The needle stitches into the material to be sewn through a recess in the plate with the upper thread being taken along by the needle. Under the needle plate, there is a substantially drum-shaped shuttle containing a thread bobbin with the lower thread. The shuttle is synchronously driven with the needle movement and it effects a loop formation between the upper thread and the lower thread. Such sewing machines require a transport of the material to be sewn by the sewing machine during sewing.

Further, sewing machines are known which are mounted to a moving device and which are moved along the intended seam line. The moving device can be configured such that the sewing machine can carry out movements in three-dimensional space while the material to be sewn is retained on a support for the material to be sewn.

In sewing machines, the upper thread is pulled off a thread bobbin being capable of receiving a relatively large amount of thread. The lower thread, however, is arranged on a bobbin being arranged in the shuttle and having relatively small dimensions and only being capable of receiving a relatively small thread supply of e.g. a length of 30 m (a length of 70 m at maximum). Therefore, this bobbin has to be changed often. Any change of the lower thread bobbin has to be effected manually by an operator which requires a lot of time. During the whole period of changing the bobbin, the sewing machine is inoperative.

SUMMARY OF THE INVENTION

It is the object of the invention to provide a sewing device wherein the stop periods of the sewing machine for the bobbin change are reduced.

In the sewing device according to the invention, the main motor as well as the members serving for the transport of the upper thread are components of a basic unit to which a shuttle block is replaceably mounted. The shuttle head carries the shuttle and the lower thread bobbin arranged therein and thus all components required for the movement and the loop formation of the lower thread. When the lower thread bobbin is empty, the shuttle block as a whole can be removed and replaced by a shuttle block with a full lower thread bobbin for which provision has been made before. Thus, the replacement of the bobbin is effected by inserting an entire shuttle head. This change can be carried out automatically without manual operation, whereas the bobbin replacement in the shuttle head requires manual operation. The replacement of the bobbin on the shuttle head after removal from the basic unit can be performed manually or automatically without there being a need to hurry, as the basic unit provided with another shuttle head can already continue its operation now as sewing machine.

The basic unit and the shuttle block are connected by a coupling means for establishing the drive connection for the shuttle. Thus, the synchronization of the shuttle movement with the movement of the needle bar is effected. Synchronization does not mean that the two mentioned components perform equal movements, but that the movement processes of these components are coordinated with respect to each other.

Normally, the sewing machine comprises only one single motor, namely the main motor which drives the needle movement as well as the shuttle movement. In such case, the coupling means consists of a coupling being capable of operatively connecting the output shaft of the basic unit to the input shaft of the shuttle block. Therefore, a common coupling or a gearwheel coupling can be used. However, it is also possible to provide the shuttle with its own drive motor. In this case, the coupling means consists of a plug-in coupling which connects the supply and control means of the basic unit to corresponding lines of the shuttle block, with the drives of main motor and shuttle motor for the mentioned synchronous operation being coordinated.

For changing a shuttle block, a change station with at least one reception unit may be provided. When the end of the thread supply of the shuttle bobbin is detected or signalized, the moving device moves the sewing machine such that the shuttle block mounted to the basic unit is inserted into a reception unit. In the reception unit, the shuttle block is locked and at the sewing machine, this shuttle block is unlocked. Then, the sewing machine can be moved to another reception unit containing a shuttle block with a full bobbin.

In order to prevent that the bobbin or the shuttle of a shuttle block located in a reception unit is rotated unintentionally when changing the bobbin, a retention device for locking the input shaft of the shuttle block may be provided. When rotating the shuttle shaft, the synchronism between the needle lever and the shuttle rotation would be disturbed when, subsequently, the coupling of the shuttle block to the basic unit takes place. In case that the basic unit is driven, it is ensured that, upon reinserting, the driving gearwheel takes a defined rotational position and meshes with the same tooth.

The sewing device according to the invention is especially suitable for such cases where the sewing machine is mounted to a moving device, e.g. to a robot arm which guides the sewing machine along a predetermined three-dimensional path, and is also capable of moving the sewing machine for putting down the shuttle block and for receiving a new shuttle block. The invention, however, is also applicable with such sewing devices which are operated in a stationary manner and with such ones wherein the entire shuttle block is replaced by a new shuttle block with a full lower thread bobbin when the lower thread bobbin has become empty.

Referring to the drawings, embodiments of the invention are hereinafter explained in more detail. In the drawings:

BRIEF DESCRIPTION OF THE DRAWINGS

FIG. 2 is a schematic illustration of the sewing machine before the shuttle block is inserted into a change station, FIG. 3 is a sectional view through the shuttle containing the thread bobbin, FIG. 4 is a side view of the shuttle.

DESCRIPTION OF THE PREFERRED EMBODIMENTS

Figure 1:
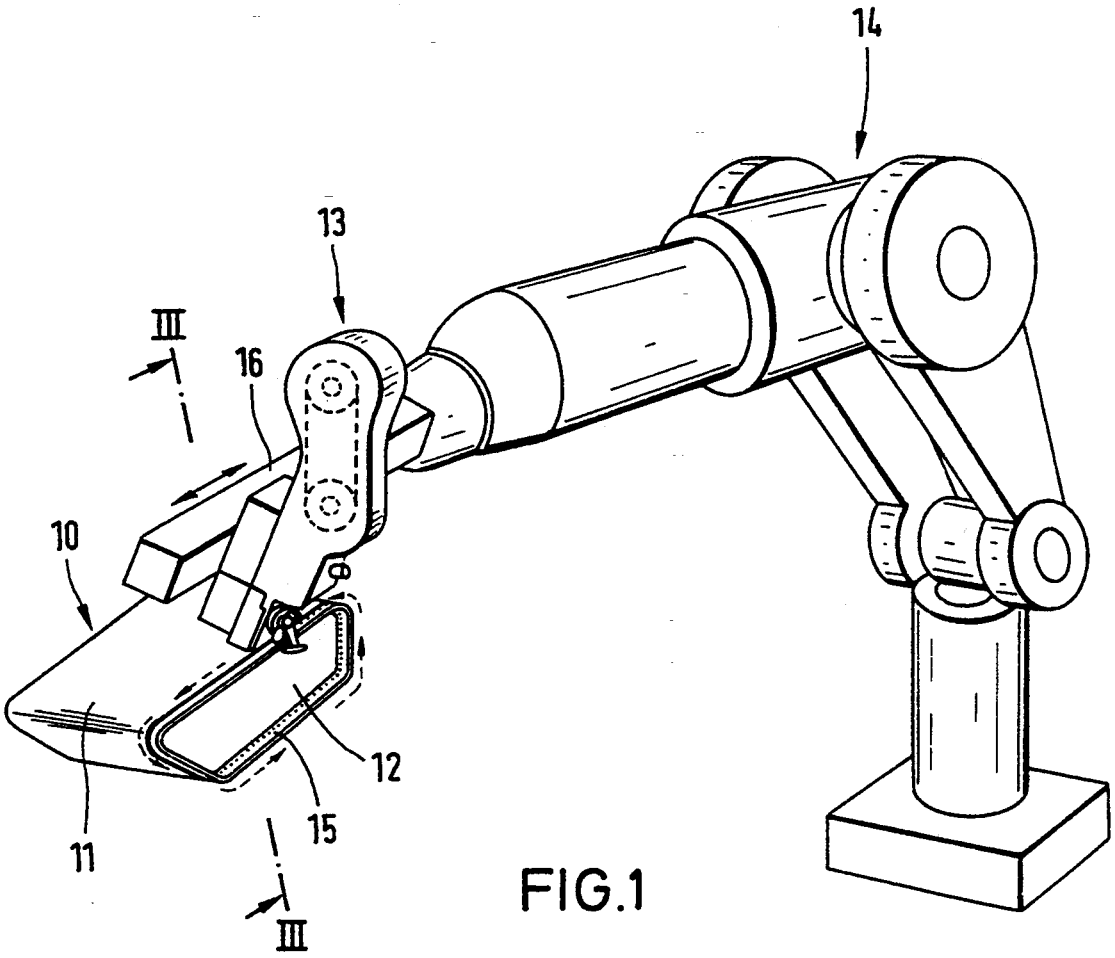
FIG. 1 is a schematic perspective illustration of the sewing device.

In FIG. 1, a support 10 for material to be sewn is shown on which the blanks 11 and 12 to be sewn together are retained. The sewing machine 13 is guided by a moving device 14 along the intended seam line 15. Here, the moving device 14 is a robot or manipulator means or manipulator arm means including a manipulator arm 16. The sewing machine 13 is fastened to the manipulator arm 16 which can be moved or rotated along a plurality of axes. The moving device 14 is controlled by a computer such that the sewing machine 13 is moved exactly along the seam line 15. The moving device 14 can transport the sewing machine 13 to the change station illustrated in FIG. 2, which change station comprises two stationary reception units or first and second holding means 21 and 22, respectively. The sewing machine 13 consists of a basic unit 23 and an interchangeable shuttle or looper block 24 which is detachably mounted thereto. The basic unit 23 comprises a housing 25 with a bracket 26 to which a needle bar 27 being pivotable about a horizontal axis 28 is mounted. The axis 28 is reciprocatingly driven by the main motor (not shown) of the sewing machine. The needle bar 27 carries a needle 29 which is bent around the axis 28 and which stitches through a recess of a holding-down member 30 which is supported coaxially to the axis 28. Further, a take-up lever 31 is supported on the basic unit 13, which is also reciprocatingly driven by the main motor and comprises an eyelet through which the upper thread 33 is led before it reaches the needle eye of the needle 29. The bevelled gearwheel 41 protruding out of the basic unit 23 is driven by the output shaft 39 which, on its part, is driven by the main motor.

The shuttle or looper block 24 which is detachably mounted to the underside of the housing 25 of the basic unit 23 supports on a foot protruding towards the holding-down member 30 a needle plate 34 against which the cloth to be sewn is pressed by the holding-down member 30. The needle plate 34 comprises an opening for the passage of the needle 29. Behind the needle plate 34, a looper which can be either a rotary hook or a shuttle 35 is arranged which contains the thread bobbin 36 for the lower thread. The shuttle 35 is driven by a shaft 37 which is driven via a synchronous releasable coupling means or detachable mounting means; and by the main motor contained in the basic unit 13. This rotation of the shuttle 35 is synchronized with the movements of the take-up lever 31, the needle bar 27 and the holding-down member 30.

Before each stitch of the needle 29, the holding-down member 30 presses the cloth against the needle plate 34. Then, the needle 29 carries out the stitch, the upper thread 33 being looped with the lower thread pulled off the thread bobbin 36. Subsequently, the needle 29 is withdrawn and the holding-down member 30 is moved back, too, in order to release the cloth. Thereafter, the next advancing step is performed along the intended seam line, which step can be carried out by the moving device 14. Alternatively, it is also possible to provide for a corresponding advancing device at the sewing machine 13. The shaft 37 projects at both sides out of the housing of the shuttle block 24. At the one end thereof, the shuttle 35 is arranged and at the opposite end, first drive means in the form of a double-bevel gearwheel 40 is arranged, which, together with second drive means in the form of a bevelled gearwheel 41 of the basic unit 13, forms the coupling means 38. When the shuttle block 24 is coupled to the basic unit 13, the two bevel gearwheels 40 and 41 get into mutual engagement with their toothings.

According to FIGS. 3 and 4, the shuttle 35 fastened to the shaft 37 comprises a shuttling structure 43 with thread guide paths 44. The shuttling structure 43 encloses a bobbin case 45 in which the exchangeable thread bobbin 36 for the lower thread is arranged. The shuttle 35 functions so as to knot the upper thread and the lower thread in cooperation with the needle 29.

Figure 5:
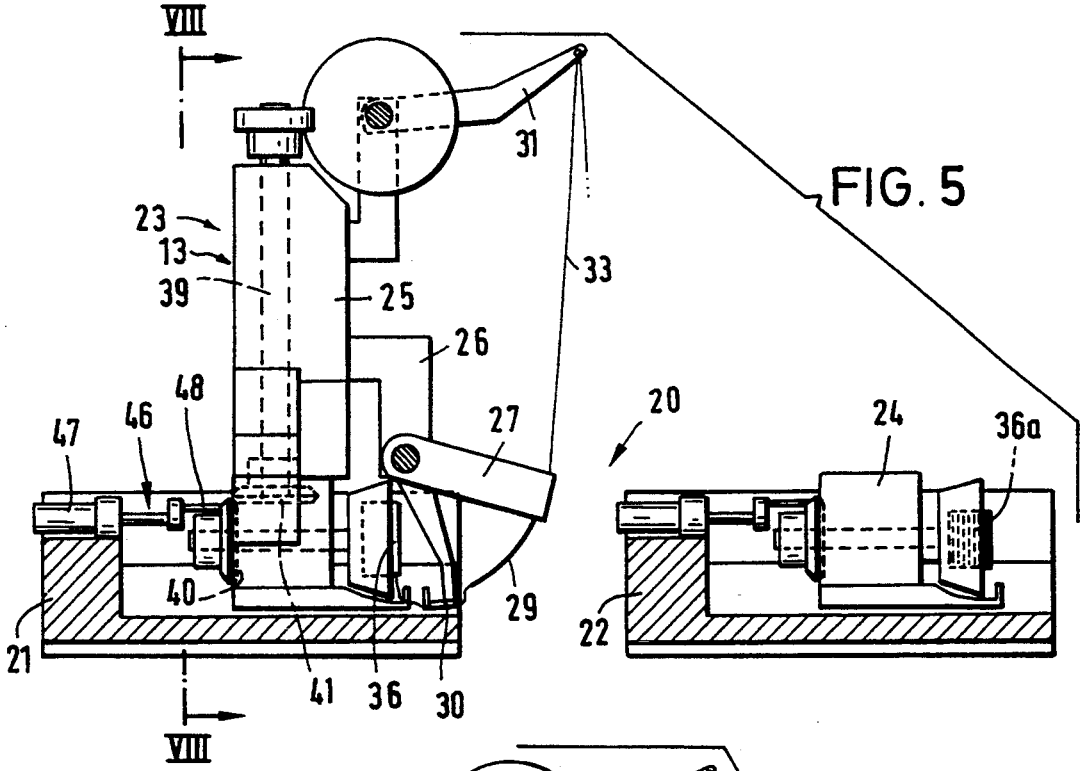
FIG. 5 shows the insertion of the shuttle block of the sewing machine into a reception unit of the change station.
Figure 6:
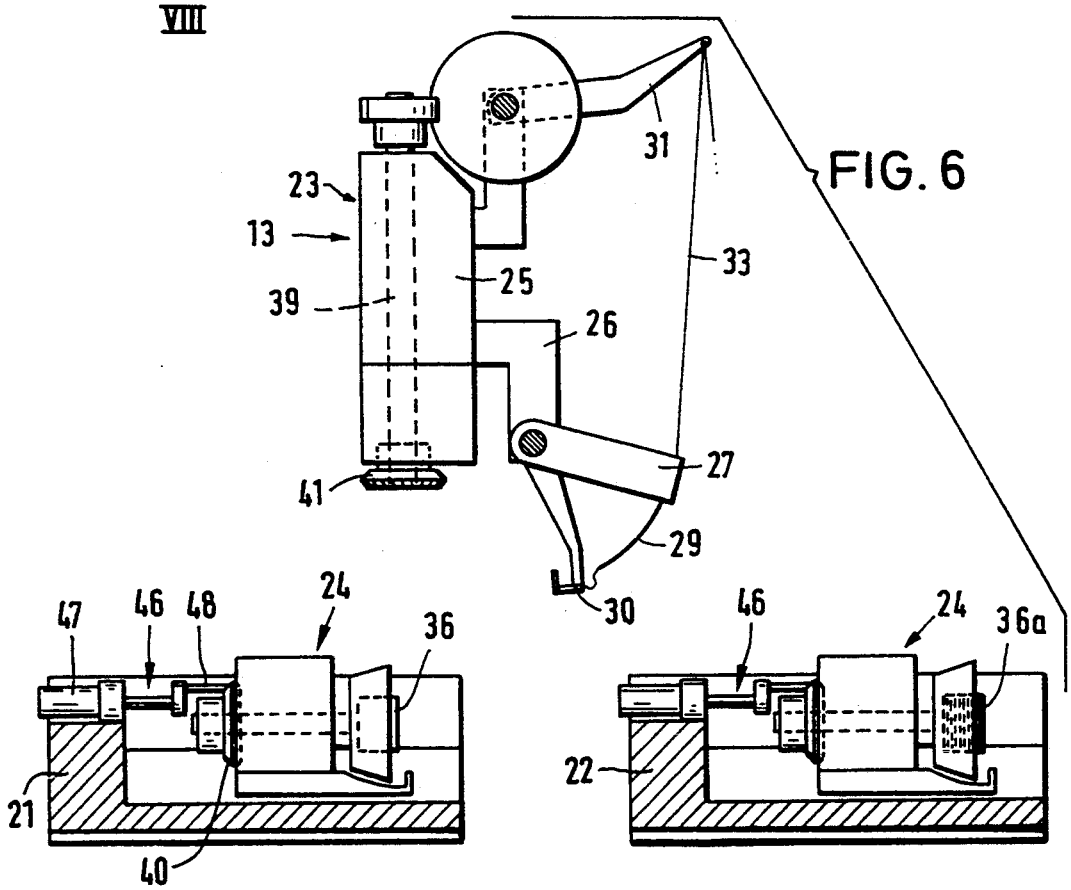
FIG. 6 shows the movement of the basic unit to an adjacent reception unit of the same change station.
Figure 7:
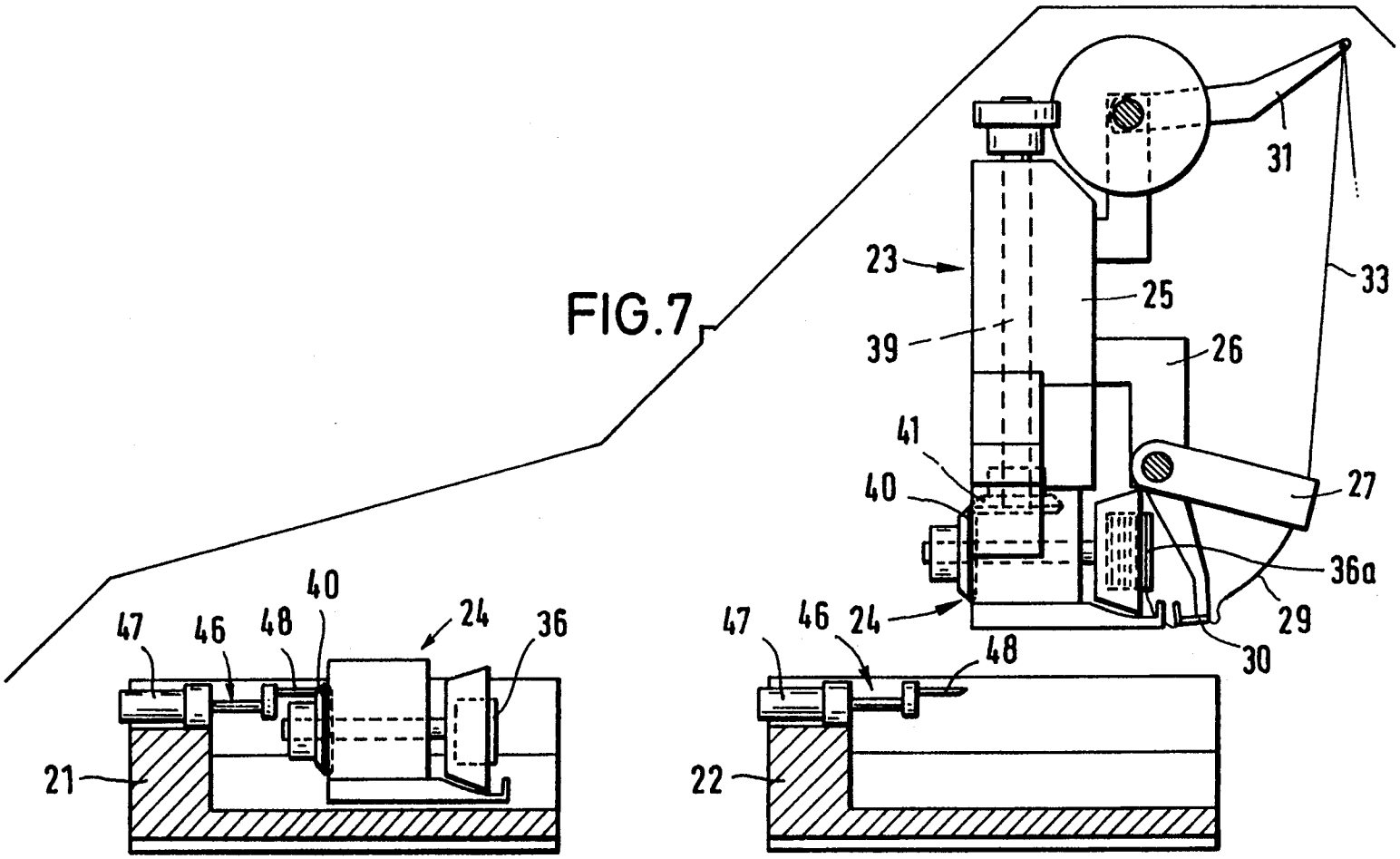
FIG. 7 shows the progression of the now recompleted sewing machine out of the second reception unit.

When the thread bobbin 36 for the lower thread has become empty during sewing according to FIG. 1, the moving device 14 transports the entire sewing machine 13 according to FIG. 2 into a reception unit 21 of the change station 20. There, the sewing machine is put down and the shuttle block 24 is fixed and retained in the reception unit 21. Then, the connection between the basic unit 23 and the shuttle block 24 is released and the moving device transports the basic unit 23 to the other reception unit 22 which contains a shuttle block 24 with a full thread bobbin 36a. Now, the shuttle block 24 is locked to the basic unit 23 and taken out of the reception unit 22. Then, the sewing machine is immediately operative again. In FIG. 5, the putting down of a shuttle block 24 with empty thread bobbin 36 in the one reception unit is shown, while, in the other reception unit, a shuttle block with full thread bobbin 36 is arranged. FIG. 6 shows the transfer of the basic unit 23 of the shuttle block with an empty thread bobbin to the shuttle block with a full thread bobbin and FIG. 7 shows the removal of the now complete sewing machine comprising the shuttle block with the full thread bobbin from the reception unit 22.

The reception units 21 and 22 are equally configured. Each reception unit comprises a retention device 46 for locking the shaft 37 of the shuttle block 24. In the present case, this retention device consists of a piston-cylinder unit 47 moving a pin 48 which is capable of engaging into the outer toothing of the double-bevel gearwheel 40 when the shuttle block 24 is located in the proper position in the reception unit. By means of the retention device 46, it is prevented that the shaft 37 may be rotated unintentionally during changing the thread bobbin 36. Thereby, it is ensured that the basic unit 23 receives the shuttle block 24 in the same state in which the shuttle block has been put down. This is important in order to assure that the synchronization between the components of the basic unit and the shuttle block does not get lost. It is advisable to provide for the locking of shuttle block and basic unit such that both parts can only be decoupled from each other in case of a very specific defined phase position of the cycle of the main drive. Thus, it is ensured that the decoupling and coupling of the shuttle block is always effected in a defined phase position of the motor cycle, i.e. in case of specific positions of take-up lever 31 and needle shaft 27.

Alternatively to the retention device 46 provided at the reception unit, such a retention device may be provided at the shuttle block 24, the locking of the shaft 37 being always effected when the shuttle block is released from the basic unit.

Figure 8:
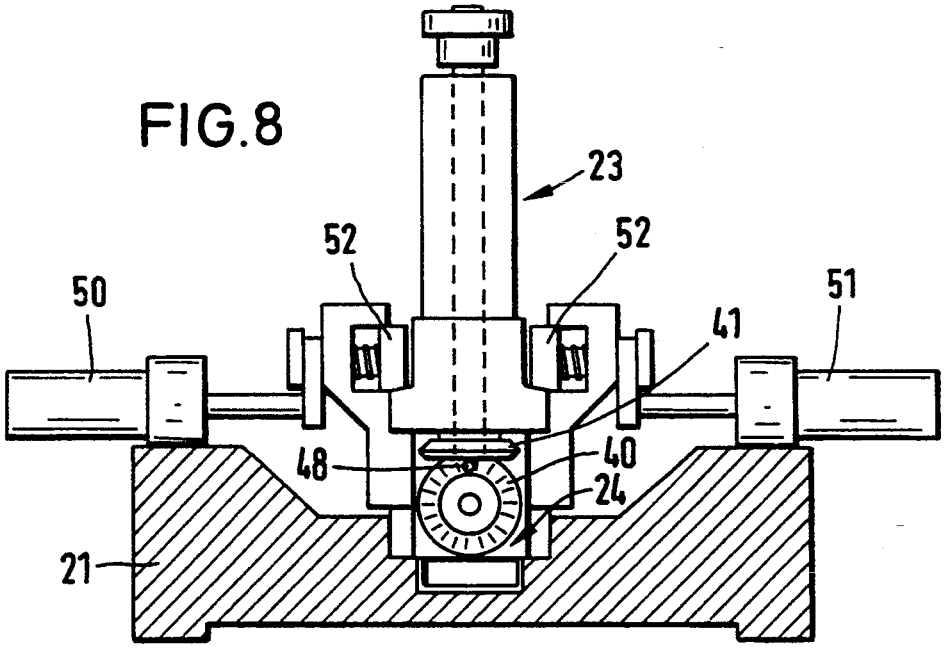
FIG. 8 is a sectional view along the line VIII—VIII of FIG. 5.

According to FIG. 8, each reception unit 21,22 comprises two laterally arranged piston-cylinder units 50,51 which move clamping jaws 52 from opposite sides against the shuttle block 24 and thus retain the shuttle block and fix it in the reception unit. Thereafter, the shuttle block 24 is unlocked from the basic unit 23 and the basic unit 23 is drawn off the moving device 14, the bevel gearwheel 41 removing together with the basic unit 23 from the shuttle block 24.

Figure 9:
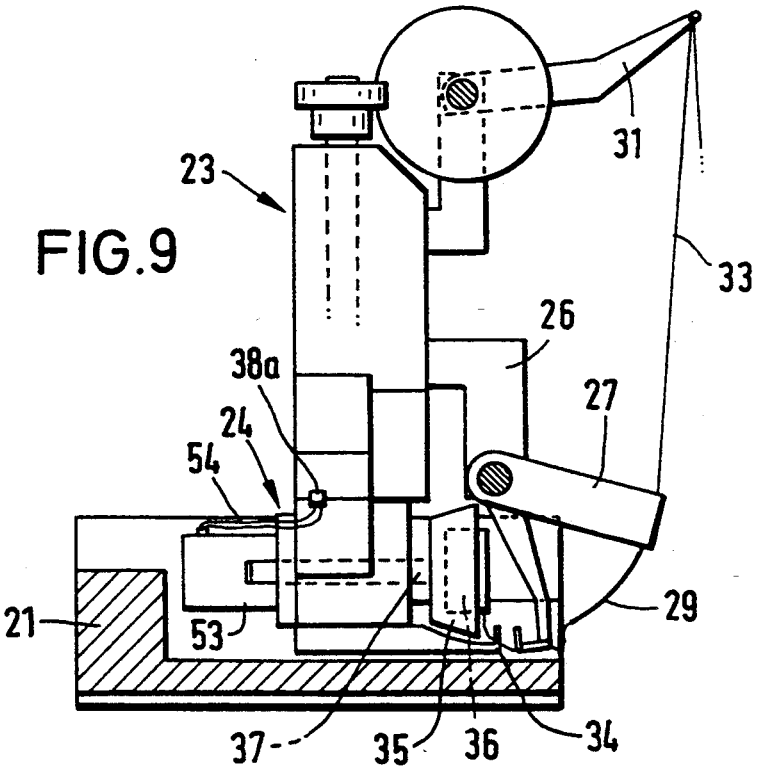
FIG. 9 shows a sewing machine according to a second embodiment, with the shuttle block having an own motor, in a reception unit.

In the embodiment of FIG. 9, the shuttle block 24 is provided with its own drive motor 53 for the shaft 37 of the shuttle 35. The drive motor 53 is controlled by the basic unit 23 to which it is connected via control and supply cables 54. The drive connection is established via a coupling means 38a configured as electrical plug-in coupling by which the synchronization between main motor and drive motor 53 is also effected. Preferably, the drive motor 53 is a motor which blocks the rotation of the shaft 37 in its off-state.

It is within the scope of the invention to also use a sewing machine with an axially moved needle bar, instead of a sewing machine with a pivotable needle bar 27.

Although a preferred embodiment of the invention has been specifically illustrated and described herein, it is to be understood that minor variations may be made in the apparatus without departing from the spirit and scope of the invention, as defined the appended claims.

We claim:

1. A sewing device comprising a sewing machine (13), said sewing machine including a movable needle bar (27) driven by a main motor as well as a looper (35) with a thread bobbin (36) driven synchronously with said needle bar (27), said sewing machine (13) including a basic unit (23) which includes said main motor and said needle bar (27), said basic unit (23) including a looper block (24) detachably mounted to said basic unit (23) and carrying said looper (35), said basic unit (23) and said looper block (24) being interconnected by coupling means **(38, 38*a*) constructed and arranged for establishing a drive for said looper (35), a change station (20) including at least one reception unit (21 or 22) for taking over and retaining said looper block (24) detached from said basic unit (23), and said at least one reception unit (21 or 22) includes a retention device (46) for retaining a shaft (37) of said looper block (24)**.

2. The sewing device according to claim 1, characterized in that said coupling means (38) connects an output shaft (39) of said basic unit (23) driven by said main motor to a shaft (37) of said shuttle block (24).

3. The sewing device according to claim 1, characterized in that said coupling means **(38*a*) connects said basic unit ( 23 ) via a control and supply cable (54) to said shuttle block (24) which includes its own drive motor (53)**.

4. The sewing device as defined in claim 1 wherein said change station (20) includes at least two reception units (21 and 22), one of said reception units (22) contains a looper block (24) and a substantially full thread bobbin **(36*a*) and another of said reception units (21) is free to receive a looper block (24) and its associated less than full thread bobbin (36) when the latter is removed from said basic unit (23)**.

5. The sewing device as defined in claim 1 including manipulator arm means (16) for carrying and manipulating said sewing machine (13).

6. The sewing device as defined in claim 1 including manipulator arm means (16) for carrying and manipulating said sewing machine (13) for movement relative to a desired seam line (15).

7. The sewing device as defined in claim 1 including manipulator arm means (16) for carrying and manipulating said sewing machine (13) for movement along a plurality of axes.

8. The sewing device as defined in claim 1 including manipulator arm means (16) for carrying and manipulating said sewing machine (13) for movement along a plurality of axes including rotational movement relative to at least one of said plurality of axes.

9. A sewing device comprising a sewing machine (13), said sewing machine (13) including a basic unit (23) having main motor means for imparting movement to a movable needle bar (27), a looper (35) rotatably carried by an interchangeable looper block (24), means (38) for effecting a synchronous detachable mounting between said looper block (24) and said basic unit (23), said synchronous detachable mounting means (38) including first (40) and second (41) drive means controlled by said main motor means for imparting synchronous rotation through said first drive means (40) to synchronously rotate said looper (35), said first (40) and second (41) drive means are each a gear which intermesh automatically with each other upon mounting being effected between said looper block (24) and said basic unit (23), another looper (35) rotatably carried by another interchangeable looper block (24), first and second holding means (21, 22) for selectively holding one of said looper blocks while another of said looper blocks is carried by said basic unit (23), and means (46) for selectively detachably securing said looper block (24) to said first and second holding means (21, 22).

10. The sewing device as defined in claim 9 including manipulator arm means (16) for carrying and manipulating said sewing machine (13) for selective movement relative to said first and second holding means (21, 22).

11. A sewing device comprising a lock stitch sewing machine (13), said lock stitch sewing machine (13) including a basic unit (23) having main motor means for imparting movement to a movable needle bar (27), a looper (35) including a spool with a thread supply rotatably carried by an interchangeable looper block (24), means **(38*a*) for effecting a synchronous releasable mounting between said looper block (24) and said basic unit (23), said synchronous releasable mounting means (38*a*) including control means (54) and drive means (53) controlled by said main motor means for imparting synchronous rotation through said drive means (53) to synchronously rotate said looper (35)**, said drive means

(53) is a drive motor which is driven in synchronism with the main motor means upon mounting being effected between said looper block (24) and said basic unit (23), another looper (35) rotatably carried by another interchangeable looper block (24), first and second holding means (21, 22) for selectively holding one of said looper blocks while another of said looper blocks is carried by said basic unit (23), and means (46) for selectively detachably securing said looper block (24) to said first and second holding means (21, 22).

12. The sewing device as defined in claim 11 including manipulator arm means (16) for carrying and manipulating said sewing machine (13) for selective movement relative to said first and second holding means (21, 22).

13. A sewing device comprising a sewing machine (13), said sewing machine (13) including a basic unit (23) having means for imparting movement to a movable needle bar (27), first and second substantially identical interchangeable looper blocks (24) carrying a first thread bobbin (36) and a second thread bobbin (36*a*), respectively; means (38, 38*a*) for detachably mounting and dismounting said first and second interchangeable looper blocks (24) relative to said basic unit (23), said first interchangeable looper block (24) and its first thread bobbin (36) being coupled by said mounting and dismounting means (38) to said basic unit (23) during at least one phase of operation of the sewing device, first holding means (22) for holding said second interchangeable looper block (24) and its second thread bobbin (36*a*) in readiness during said one operation phase preparatory to being substituted for said first interchangeable looper block (24) and its first thread bobbin (36), and second holding means (21) for holding said first interchangeable looper block (24) and its first thread bobbin (36) upon the dismounting of said first interchangeable looper block (24) from said basic unit (23) by said mounting and dismounting means (38) during a second phase of operation of the sewing device.

14. The sewing device as defined in claim 19 including means (14) for moving said sewing machine (13) relative to said first (22) and second (21) holding means.

15. The sewing device as defined in claim 13 wherein said first thread bobbin (36) is less than substantially full of thread and said second thread bobbin (36*a*) is substantially full of thread.

* * * * *